United States Patent [19]

Snowden

[11] 4,178,336

[45] Dec. 11, 1979

[54] PRODUCTION OF FIBRES

[75] Inventor: Paul Snowden, Stockton-on-Tees, England

[73] Assignee: Imperial Chemical Industries Limited, London, England

[21] Appl. No.: 885,344

[22] Filed: Mar. 10, 1978

[30] Foreign Application Priority Data

Mar. 11, 1977 [GB] United Kingdom ..... 10405/77

[51] Int. Cl.[2] ..... B22D 23/08

[52] U.S. Cl. ..... 264/8; 264/12; 264/164; 264/236

[58] Field of Search ..... 264/8–13, 264/164, 238

[56] References Cited

U.S. PATENT DOCUMENTS

| | | | |
|---|---|---|---|
| 1,357,206 | 10/1920 | Zuller | 264/83 |
| 2,336,743 | 12/1943 | Manning | 264/DIG. 75 |
| 2,433,000 | 12/1947 | Manning | 264/DIG. 75 |
| 3,174,182 | 3/1965 | Duncan | 264/8 |

FOREIGN PATENT DOCUMENTS

| | | | |
|---|---|---|---|
| 1127537 | 11/1962 | Fed. Rep. of Germany . | |
| 1199431 | 8/1965 | Fed. Rep. of Germany . | |
| 1421674 | 4/1970 | Fed. Rep. of Germany . | |
| 48-13942 | 5/1973 | Japan | 528/503 |
| 51-53013 | 5/1976 | Japan | 264/12 |
| 1270679 | 9/1977 | United Kingdom . | |

*Primary Examiner*—Jay H. Woo

*Attorney, Agent, or Firm*—Cushman, Darby & Cushman

[57] ABSTRACT

Formaldehyde resin fibres, in particular urea formaldehyde resin fibres, are produced by introducing a liquid formaldehyde resin and a catalyst into a spinning cup in the presence of cold humid air which inhibits drying and reaction, centrifugally spinning fibres from the cup into the path of hot air currents, at between 50° C. and 100° C., which dry the fibres without curing them, and curing and chemically stabilizing the dry fibres by heating at above 100° C. until they are insoluble in cold water.

10 Claims, 8 Drawing Figures

PRODUCTION OF FIBRES

The present invention relates to a process for centrifugally spinning fibres from a liquid formaldehyde resin. The formaldehyde resin is preferably urea formaldehyde resin, but it may be melamine formaldehyde resin, phenol formaldehyde resin, resorcinol formaldehyde resin, cresol formaldehyde resin, or a mixture of any two or more of the said resins. The invention is hereinafter described with particular reference to the centrifugal spinning of UF resin.

A liquid UF resin is used (for example an aqueous solution thereof) and its viscosity adjusted, if necessary, to a preselected value between 5 and 300 poise, preferably between 15 and 75 poise. The resin is mixed with a liquid catalyst which allows the resin to have a usefully long pot-life at room temperature but which, at temperatures above 100° C., particularly above 120° C., cures and chemically stabilizes the resin and renders it insoluble in cold water.

The liquid resin and catalyst mixture (if desired with one or more additives, such as a spinning aid and/or a surfactant) is fed at a preselected (but variable) rate into a spinning-cup or the like rotating at a high pre-selected (but variable), speed, Purely by way of example, cups having diameters in the range of 3" to 5" have been used with rotational speeds of 3000 to 5000 rpm.

The resin/catalyst mixture in the spinning cup is located below and in the path of a downward flow of cold humid air, part of which enters the cup substantially co-currently with the mixture and part of which may be deflected outwards by and away from the cup as outwardly-directed currents of cold humid air. The purpose of the cold, humid air is to inhibit drying or reaction of the resin/catalyst mixture at least whilst in the cup. Usually ambient air may be used, but if necessary its temperature and humidity may be adjusted as required.

The resin/catalyst mixture, in the presence of cold humid air, flows over the inner surface and wall of the cup, and is spun centrifugally outwards with the cold humid air, from the rim of the cup or from a plurality of apertures provided at regular intervals in the circumference of the wall of the cup, in the form of individual separate fibres. As the fibres spin outwards from the cup in the presence of the cold humid air currents and before they are dried or cured, they continue to be drawn out and become attenuated or stretched into fibres of smaller diameter. When they have achieved the desired diameter and before they have had a chance to develop into droplets or shot, they are dried and physically stabilized by heat, and transported to a collecting zone.

These latter heating and transporting steps are carried out by hot, dry currents of air flowing outwards from below, and away from, the spinning cup. Hot, dry air may be caused to flow from below the cup towards the bottom of the cup, which deflects it outwards. If necessary, means may be provided on the bottom of the cup (for example an axial fan and/or a radial propeller or the like) to ensure that the hot air is deflected to form outwardly-flowing hot dry air currents. The hot air is at a temperature which will heat the fibres above 50° C. but below 100° C., typically to 65° C. or 70° C., at which temperature the fibres are dried and physically stabilized without, however, causing the catalyst to cure and chemically stabilize them. The hot dry air currents also serve the purpose of supporting the fibres and carrying them to a collecting zone which, in unconfined conditions, would normally be in the form of an annulus having the spinning cup as its centre, but at some distance away from, and below, the cup.

The dried (but uncured) fibres are removed from the collecting zone and then cured and chemically stabilized by the catalyst, by heating (for example in an oven) at over 100° C., typically at between 120° C. and 140° C. until the cure is complete and the fibres are insoluble in cold water.

The present invention accordingly provides a process for centrifugally spinning formaldehyde fibres from a liquid formaldehyde resin which comprises the steps of feeding the resin and a resin-curing catalyst, which at temperatures above 100° C. will cure and chemically stabilize the resin and render it insoluble in cold water, into a rotating spinning cup, directing downwardly towards the cup a flow of cold, humid air, at least part of which flow enters the cup with the resin/catalyst mixture, the temperature and humidity of the air being such that it inhibits drying and reaction of the resin/catalyst mixture whilst in the cup, the rotation of the cup causing the resin/catalyst mixture to flow as an even film over the inner surface of the cup, in the presence of the cold, humid air, and to be spun centrifugally from the outer wall of the cup, in the form of individual, separate fibres which attenuate or stretch until they have achieved the desired diameter, providing from below the cup outwardly-directed currents of hot dry air at a temperature such as to heat the fibres to between 50° C. and 100° C. to dry the attenuated or stretched fibres and transport them to a collecting zone, removing the dry fibres from the collecting zone, and curing and chemically stabilizing them by heating at above 100° C. until they are insoluble in cold water.

Preferably, at least part of the downwardly-directed flow of cold, humid air is deflected outwardly by the cup to form outwardly-directed currents of cold humid air, and the fibres are spun from the cup into the path of the said currents.

The invention is hereinafter described with reference to the accompanying drawings, wherein.

Figure 1:
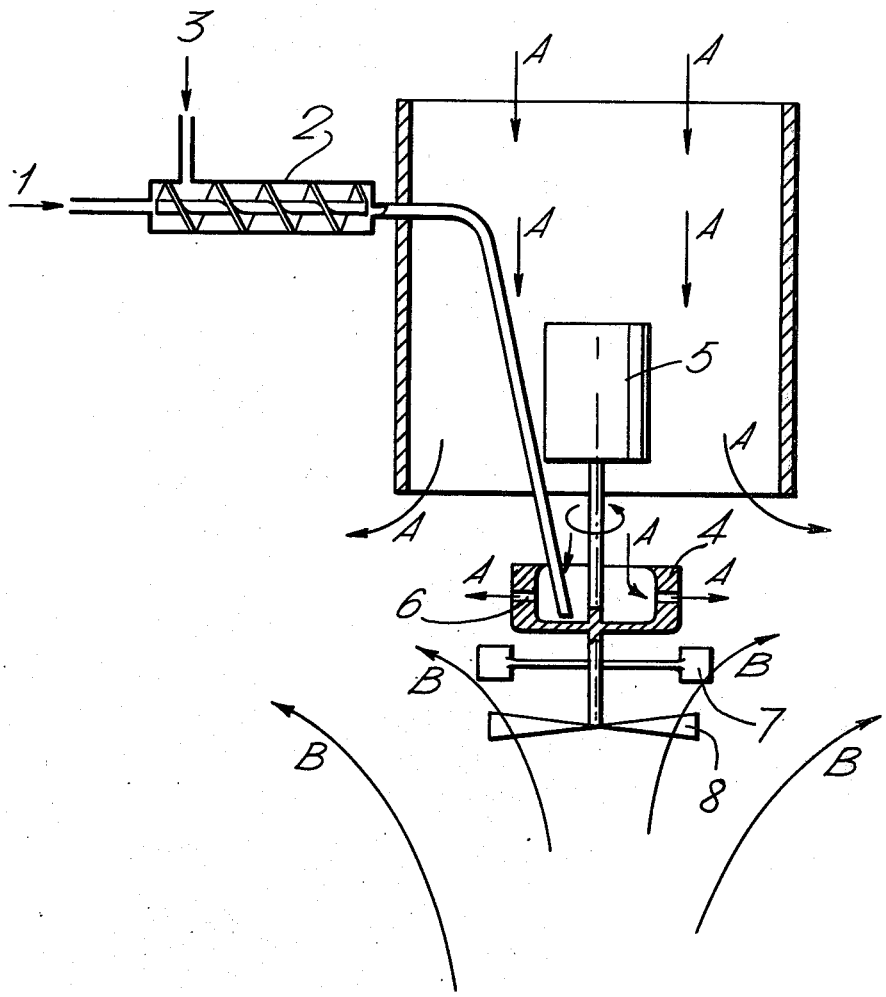
FIG. 1 illustrates, schematically, the process according to the invention for centrifugally spinning and collecting formaldehyde resin fibres by introducing a liquid resin (for example, an aqueous urea formaldehyde resin) into a rotating cup.

Referring to FIG. 1, aqueous UF resin of viscosity 5 to 300 poise, preferably 10 to 100 poise, more preferably 15 to 75 poise, is introduced at 1 into a mixer 2, where it is mixed with an aqueous solution of a resin-curing catalyst introduced at 3. (The addition of a spinning aid, such as polyethylene oxide solution, and/or of a surfactant, such as "Lissapol", to the mixer 2 is advantageous). From the mixer 2, the UF resin mixture is introduced onto the base of a rotating cup 4 driven by a motor 5. The resin spreads over the base and the wall of the cup 4 as a thin film, and is spun from apertures 6 in the wall of the rotating cup under such conditions as to produce a plurality of individual, separate fibres. These are allowed to attenuate or stretch to the diameter desired therefor, without drying or curing or disturbance from turbulent air, by first spinning them into a region of low temperature and high humidity. Such a region is provided by a downwardly-directed flow of cold, humid air which partly flows through the apertures 6 with the fibres and which is partly deflected outwardly by the cup, to form outwardly directed currents of cold humid air as shown by the arrows A. The pumping action caused by the rotation of the cup 4 causes the cold, humid air to be deflected outwardly with, and in the same manner and direction as, the fibres, thereby reducing the relative velocity between the cold, humid air and the resin fibres during the attenuation and stretching of the resin fibres. In most cases, ambient air will be suitable.

When the desired fibre diameter has been attained, the resin fibres are dried and transported to a fibre-collecting point by suitable outwardly-directed currents of dry, hot air indicated by arrows B in FIG. 1. These currents B may be created by a radial propellor 7 and an axial fan 8 fitted to the bottom of the cup 4. The hot dry air is at a temperature such as to heat the fibres to between 50° C. and 100° C., for example about 65° C. or 70° C.

After the spun fibres leave the cup, they continue to be drawn out and attenuated or stretched into fibres of smaller diameter, but they are physically stabilised by the heat of the dry, hot air currents B, during their free flight from the cup, after they have attained the desired diameter but before they have a chance to develop into droplets or shot.

After collection, the fibres are cured and chemically stabilized by heating, during which the catalyst not only cures them but renders them insoluble in cold water. Suitable catalysts comprise acids or acid salts, for example sulphuric acid, formic acid, ammonium salts (for example ammonium sulphate), or mixtures thereof. The curing is carried out at above 100° C., preferably above 120° C.

Figure 2:
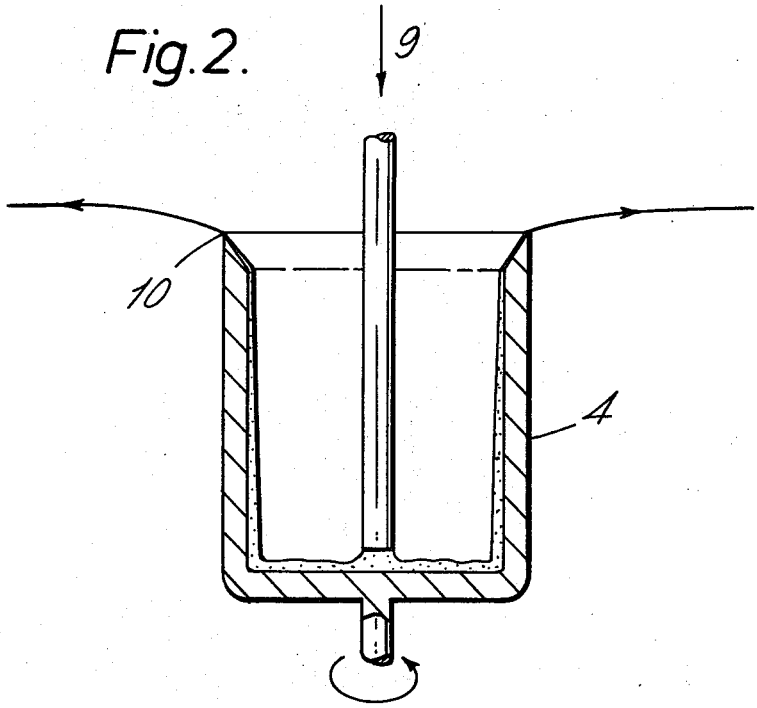
FIG. 2 illustrates one form of cup, in which the fibres are spun centrifugally from the upper lip of the cup.

One suitable cup design for use in the invention is illustrated diagiamatically in FIG. 2 of the accompanying drawings. Liquid resin (e.g. a UF resin solution) is fed through 9 with a liquid catalyst to the bottom of the rotating cup 4; it flows radially across the cup and then up the walls of the cup, where flow irregularities are smoothed under the centrifugal forces operating in the rotating cup. At the correct flow rate, fibres are spun outwardly from the lip 10 of the cup. The height of the cup is such as to allow the flow rate to be smoothed and depends upon the diameter of the cup, its rotational speed, and the viscosity of the liquid resin being spun.

The diameter of the cup and its rotational speed can be varied over quite large ranges, and are adjustable to give the flow rates required by the process.

Figure 3:
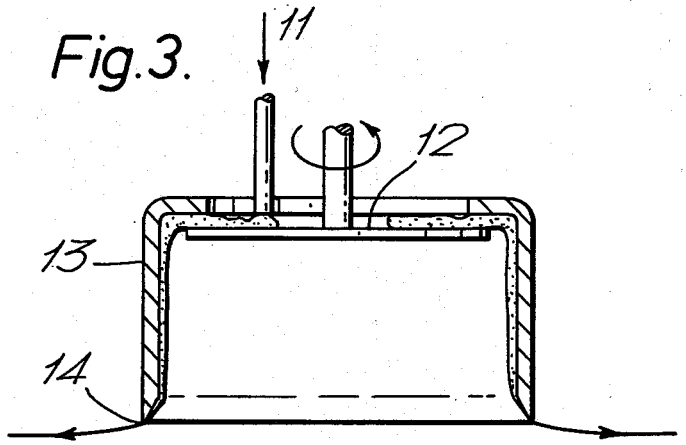
FIG. 3 illustrates an inverted cup, in which the fibres are spun centrifugally from the lower lip of the cup.

An alternative apparatus for use in the process of the invention is illustrated in FIG. 3, in which the liquid resin and catalyst are through 11 fed onto a rotating disc 12 surrounded by a downwardly-extend annular wall 13, the wall and the disc forming an inverted cup. The resin flows radially across the disc 12 and down the inner surface of the annular wall 13 where fibres are spun centrifugally outwards from the bottom lip 14 thereof.

The throughput of the cup designs illustrated in FIGS. 2 and 3 is limited by the fact that, above a certain critical resin flow-rate (which depends, inter alia, upon the diameter and depth of the cup, its rotational speed, and the viscosity of the resin), the resin tends to leave the rim of the cup as a two-dimensional sheet before breaking up into irregular fibres, instead of leaving the rim of the cup as individual, separate fibres. The effect of exceeding the critical resin flow-rate is illustrated in the Examples which follow hereunder.

Figure 4:
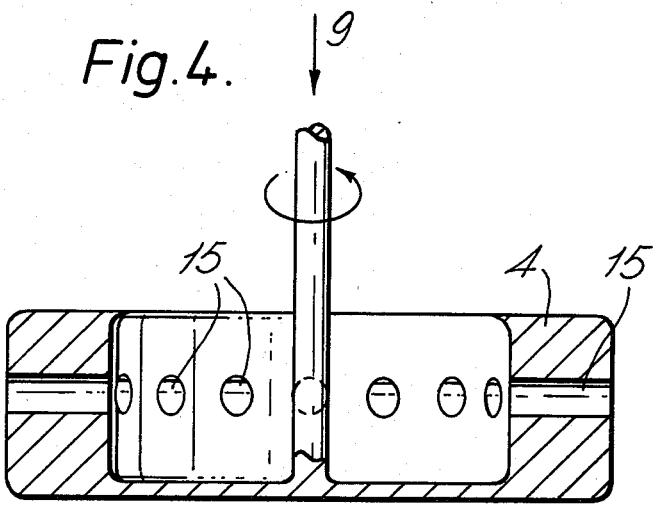
FIG. 4 illustrates another form of cup, in which the fibres are spun centrifugally through holes provided in the circumference of the cup.
Figure 4A:
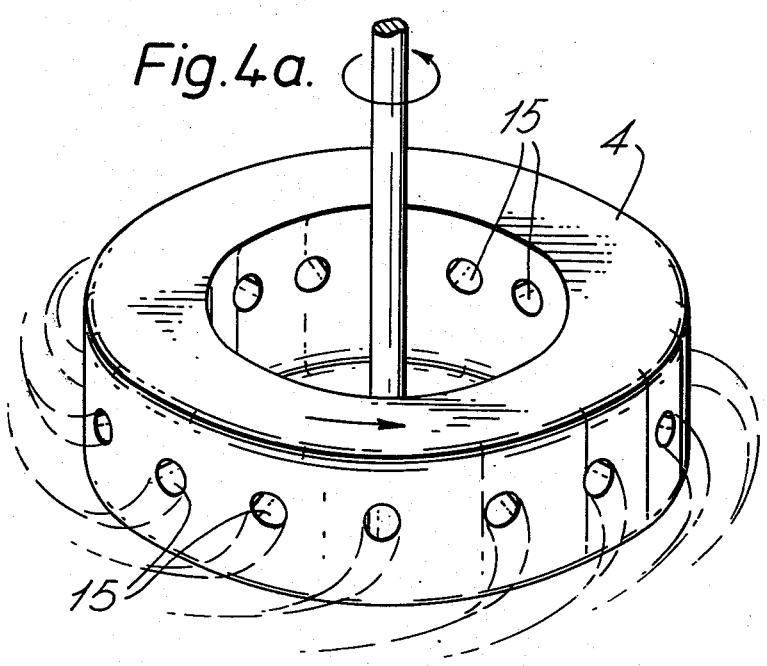
FIG. 4*a* shows the same cup in operation.

However, the limit to the resin flow-rate described above can be removed if the fibres are prevented from joining at the rim of the cup to form continuous two-dimensional liquid films. This can be achieved by the use of cups as shown in FIGS. 4 and 4*a*, in which the cup wall 4 is provided with a plurality of equidistantly-spaced holes 15 extending into the interior of the cup. The embodiments of FIGS. 4 and 4*a* are preferably operated at a resin flow rate such that the holes 15 are not completely filled with the liquid resin, but also allow the cold humid air to flow there-through together with the resin. The resin spins from the surfaces of the holes 15 as a film which collapses to form a fibre which generally has an elliptical cross-section. The distance between adjacent holes 15 must be greater than that necessary to allow for the elastic expansion of the resin upon leaving the hole.

Figure 5:
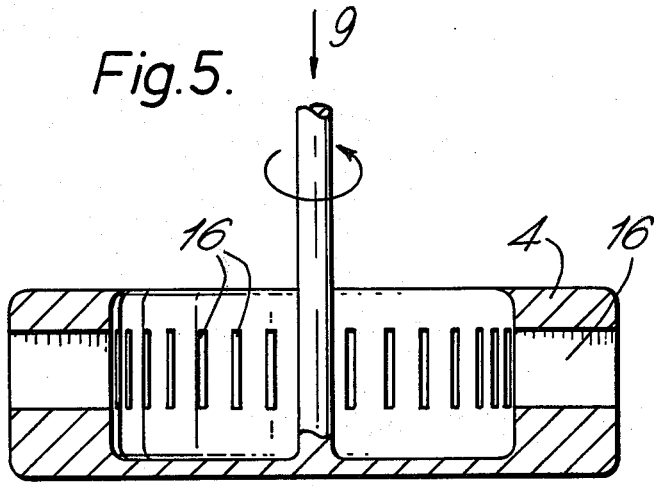
FIG. 5 illustrates another form of cup, in which the fibres are spun centrifugally through slots provided in the circumference of the cup.
Figure 5A:
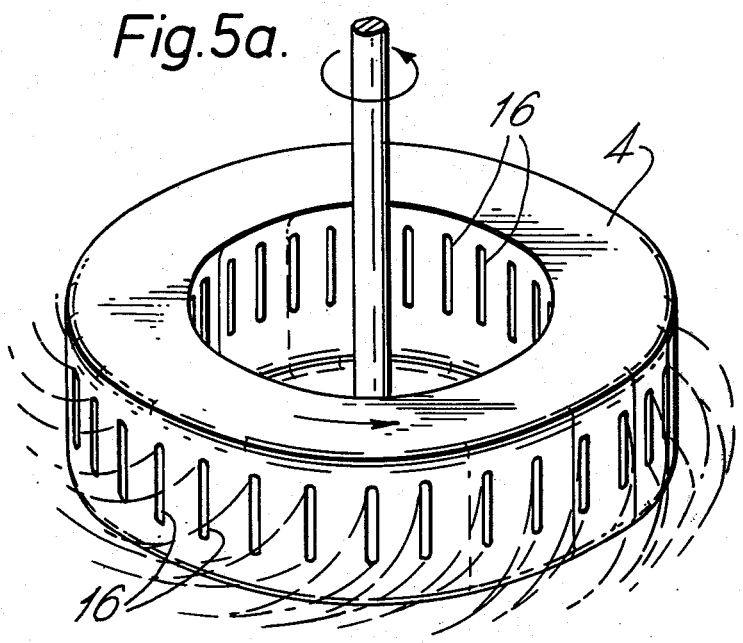
FIG. 5*a* shows the same cup in operation.

The holes 15 of FIGS. 4 and 4*a* may be replaced by equidistantly-spaced slots 16, as shown in FIGS. 5 and 5*a*.

Figure 6:
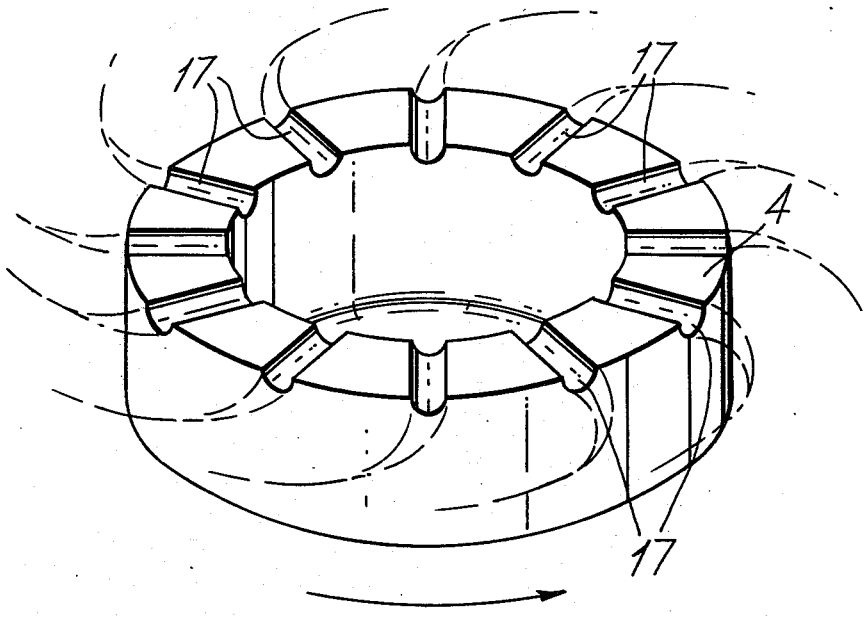
FIG. 6 illustrates an alternative form of cup, in which fibres are spun through grooves, serrations or the like provided in the upper rim of the cup.

Cups with grooved, scalloped, serrated or castellated rims 17, as shown in FIG. 6, work in the same manner as the holed or slotted cups of FIGS. 4, 4*a*, 5 and 5*a*, until the resin flow-rate is such as to cause the resin to flood over the top of the rim of the cup. At such a high flow rate, the fibres will join together as a two-dimensional sheet and the cup will have reached its useful limit for the production of good quality fibres. However, with the holed or slotted cups of FIGS. 4, 4*a*, 5 and 5*a*, the useful limit is probably not reached until the holes or slots are full of liquid.

In the following Examples 1 to 9, the experiments were carried out using aqueous urea formaldehyde resin, varying in viscosity from 15 poise to 300 poise. 3"-diameter cups and 5"-diameter cups of the types shown in FIGS. 2 and 4 were used, rotating at between 3000 rpm and 5000 rpm. In Examples 1 to 2 and 4 to 6, the resin was not catalysed, and the physical quality of the fibres was merely inspected and judged at the collecting point. In Examples 3 and 7 to 9, the resin was catalysed, and the fibres were removed from the collecting point and cured and chemically stabilised as described.

The fibres were judged to be of good quality if the bulk of them were in the form of separate, individual fibres, or as fibres sufficiently loosely stranded so as not to impede their subsequent separation, and if they were substantially free of "shot" (i.e. non-fibrous formaldehyde-resin material of a size greater than the diameter of the thickest of the fibres). Good quality fibres also had a mean diameter between 1$\mu$ and 30$\mu$, preferably between 2$\mu$ and 20$\mu$, and an average strength of at least 50 mega-Newtons per square meter. The most obvious characteristic of poor quality fibres was the presence of a substantial amount of "shot".

EXAMPLE 1

"Aerolite 300" U/F resin supplied by Ciba-Geigy was used. "Aerolite 300" is an aqueous U/F resin prepared by condensing a mixture of urea and formaldehyde in a F:U molar ratio of about 1.95:1, followed by concentration to a solids content of about 65% by weight. It has a viscosity, depending upon its age, of about 40 to 200 poise at room temperature, and a water tolerance of about 180%. The resin was adjusted to a viscosity of about 75 poise, by the addition of water, and then fed to the bottom of a 3" diameter cup shaped according to FIG. 2, and rotating at a speed of 3000 rpm. At a feed rate of about 75 ml/minute, good quality fibre was produced, having an average diameter of about 15μ. At a feed rate of 200 ml/min., the resin was spun from the rim of the cup as a continuous two-dimensional sheet and gave poor quality fibres.

EXAMPLE 2

The experiment outlined in Example 1 was repeated using "Aerolite 300" diluted to about 25 poise viscosity and with 2% "Lissapol" solution added. Good fibrallation was obtained over a range of flow rates of about 60 ml/min. to about 190 m./min. At higher flow rates, the fibres were of poorer, unacceptable quality.

EXAMPLE 3

"Aerolite 300" resin, diluted to a viscosity of about 35 poise, was mixed with 6% by weight of a 2.4% aqueous solution of polyethylene oxide and 2% by weight of a 30% solution of ammonium sulphate in water, and then fed to a 24-holed 3" diameter rotating cup of the type shown in FIG. 4. At a feed rate of about 75 ml/min., good quality fibres of average diameter about 12μ were produced at a rotational speed of 5000 rpm. The fibres were removed from the collecting point, and cured by heating in an oven at between 120° C. and 140° C. for about 4 hours. This stabilized them chemically, and rendered them insoluble in cold water. Unlike Example 1, good fibrillation was still obtained at flow rates in excess of 12 Kg/min. (approx. 9 liters/min).

EXAMPLE 4

"Aerolite 300" diluted with water to give a solution with viscosity 75 poise was spun from a 5"-diameter cup of the type shown in FIG. 2, and rotating at 3000 rpm. Good fibres were produced at rates between about 50 and 200 ml/min.

EXAMPLE 6

The experiment outlined in Example 4 was repeated, using "Aerolite 300" diluted to a viscosity of 25 poise with water, with the addition of 2% by weight of "Lissapol" solution. Good fibrillation was obtained at resin flow rates between about 100 and 250 ml/min.

EXAMPLE 7

"Aerolite 300" resin, diluted with water to about 35 poise viscosity, was mixed with 6% by weight of a 2.4% solution of polyethylene oxide and 2% by weight of a 30% aqueous solution of ammonium sulphate. This was then fed to a 24-holed 5"-diameter rotating cup of the type shown in FIG. 4. At a speed of about 5000 rpm, good fibres of average diameter about 10μ were obtained at a feed rate of about 75 ml/min. As in Example 3, good fibrillation was also observed at very much higher feed rates. The fibres were removed from the collecting point, and cured by heating at between 120° C. and 140° C. for about 4 hours. This stabilized them chemically, and rendered them insoluble in cold water.

EXAMPLE 8

The following table sets out the formulation of different resins and the conditions which were used to produce good quality fibres; in all cases a 3" cup with 24 holes was used at a rotation speed of 4500 rpm. The hot air temperature was 75° C. All the resins contained 1.6% by weight of a 2.4% polyethylene oxide solution and 7% by weight of a 30% ammonium sulphate solution. All the percentages hereunder are percentages by weight.

| | Resin | Resin Viscosity (poise) | Resin Feed Rate (g/min) |
|---|---|---|---|
| 1. | F:U ratio 1.95:1<br>Solids content 55% with 10% glycerol added | 25 | 78 |
| 2. | As (1) except 10% ethylene glycol instead of glycerol | 15 | " |
| 3. | F:U ratio 1.95:1<br>Solids content 65%, 5% melamine added | 50 | " |
| 4. | As (3) but 10% melamine added to the resin | 50 | " |
| 5. | As (4) but melamine substituted by 10% resorcinol added to the resin | 50 | " |
| 6. | As (4) but melamine substituted by 10% cresol added to the resin | 50 | " |
| 7. | As (4) but melamine substituted by 10% phenol added to the resin | 50 | " |

EXAMPLE 9

The following UF resins were fibrillated using a 5" diameter cup with 24 holes, rotating at 4500 rpm and using the same catalyst, spinning aid and hot air temperature as above.

| Resin | Resin Viscosity (poise) | Resin Feed Rate (g/min) |
|---|---|---|
| F:U ratio 1.2:1 | 35 | 50 |
| F:U ratio 1.6:1 | 50 | 50 |

All fibres produced were of good quality, and were cured at 120° C. for 3 hours.

The fibres produced in accordance with the present invention are particularly useful for use in paper-making, as described in our co-pending UK Patent Application No. 10404/77.

I claim:

1. A process for centrifugally spinning formaldehyde fibres from a liquid formaldehyde resin which comprises the steps of feeding the resin and a resin-curing catalyst, which at temperatures above 100° C. will cure and chemically stabilize the resin and render it insoluble in cold water, into a rotating spinning cup, directing downwardly towards the cup a flow of cold, humid air, at least part of which flow enters the cup with the resin/catalyst mixture, the temperature and humidity of the air being such that it inhibits drying and reaction of the resin/catalyst mixture whilst in the cup, the rotation of the cup causing the resin/catalyst mixture to flow as an even film over the inner surface of the cup, in the presence of the cold, humid air, and to be spun centrifugally from the outer wall of the cup, in the form of individual, separate fibres which attenuate until they have achieved the desired diameter, providing from below the cup outwardly-directed currents of hot dry air at a temperature such as to heat the fibres to between 50° C. and 100° C. to dry the attenuated fibres and transport them to a collecting zone, removing the dry fibres from the collecting zone, and curing and chemically stabilizing them by heating at above 100° C. until they are insoluble in cold water.

2. A process as claimed in claim 1, wherein at least part of the downwardly-directed flow of cold, humid air is deflected outwardly by the cup to form outwardly-directed currents of cold humid air, and the fibres are spun from the cup into the path of the said currents.

3. A process as claimed in claim 1, wherein the viscosity of the formaldehyde resin is adjusted to a preselected value within the range 5 to 300 poise.

4. A process as claimed in claim 1, wherein the catalyst comprises an acid or an acid salt.

5. A process as claimed in claim 1, wherein the resin/catalyst mixture contains a spinning aid, for example polyethylene oxide solution.

6. A process as claimed in claim 1, wherein the fibres are spun from the upper lip of the cup.

7. A process as claimed in claim 1, wherein the resin and catalyst are fed onto a rotating disc surrounded by a downwardly-extending annular wall forming, with the the disc, an inverted cup, the resin flows radially across the disc and down the inner surface of the annular wall, and the fibres are spun from the lower lip of the inverted cup.

8. A process as claimed in claim 1, wherein the lip of the cup is provided with a plurality of serrations equidistantly spaced around its circumference, and the fibres are spun through the said serrations.

9. A process as claimed in claim 1, wherein the outer wall of the cup is provided with a plurality of apertures equidistantly spaced around its circumference and extending inwardly to the inner wall of the cup, and the fibres are spun through the said apertures.

10. A process as claimed in claim 9 wherein the resin flow rate is such that the apertures are not filled by the resin so that the cold humid air flows through the apertures with the resin.

* * * * *